US006574866B2

(12) United States Patent
Pragt et al.

(10) Patent No.: US 6,574,866 B2
(45) Date of Patent: Jun. 10, 2003

(54) HAIR REMOVING APPARATUS COMPRISING PLATE-SHAPED CARRIERS WHICH CARE POSITIONED AND MOVABLE WITH RESPECT TO EACH OTHER

(75) Inventors: Johan Pragt, Drachten (NL); Robert Alexander Santhagens Van Eibergen, Drachten (NL); Jan Spoelstra, Drachten (NL); Fokke Roelof Voorhorst, Drachten (NL); Jasper Zuidervaart, Drachten (NL); Martijn Adriaan De Keijzer, Drachten (NL); Arjan Sander Vonk, Drachten (NL); Foppe Kramer, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/886,195

(22) Filed: Jun. 21, 2001

(65) Prior Publication Data

US 2002/0020063 A1 Feb. 21, 2002

(30) Foreign Application Priority Data

Jun. 21, 2000 (EP) ..... 00202164

(51) Int. Cl.[7] ..... B26B 19/38; B26B 19/42
(52) U.S. Cl. ..... 30/34.2; 30/45; 30/346.51
(58) Field of Search ..... 30/34.2, 43, 43.4, 30/43.7, 42, 45, 223, 233, 233.5, 346.51; 76/101.1, 104.1

(56) References Cited

U.S. PATENT DOCUMENTS 2,611,177 A * 9/1952 Halterman ..... 30/223
2,617,183 A * 11/1952 Halterman ..... 30/223
3,879,845 A * 4/1975 Hansom et al. ..... 30/45
6,405,439 B1 * 6/2002 Malobabic et al. ..... 30/346.51

FOREIGN PATENT DOCUMENTS

EP 0855256 B1 7/1998

OTHER PUBLICATIONS

"Research Disclosure" No. 591, May 1998, Publication No. 40974.

* cited by examiner

*Primary Examiner*—Hwei-Siu Payer
(74) *Attorney, Agent, or Firm*—Ernestine C. Bartlett

(57) ABSTRACT

A hair removing apparatus (1) comprising two co-operating hair processing members (17, 19), formed by plate-shaped carriers and movable relatively to each other in a direction of movement (X). The two carriers are positioned with respect to each other, viewed in a Z direction substantially perpendicular to the carriers, by a plurality of positioning members (29), which are spaced apart in the direction of movement. At least one of the two carriers has a comparatively low bending stiffness. As a result, a comparatively small and uniform gap is present between the two carriers, and the friction force acting on the carriers in a direction parallel to the direction of movement is also comparatively small. In one embodiment the positioning members (29) each have an S-shaped or C-shaped tongue (31), which is provided on a third carrier (35), the first and second carriers (21, 27) being enclosed between the third carrier and contact elements (41) of the tongues.

20 Claims, 9 Drawing Sheets

Figure 1:
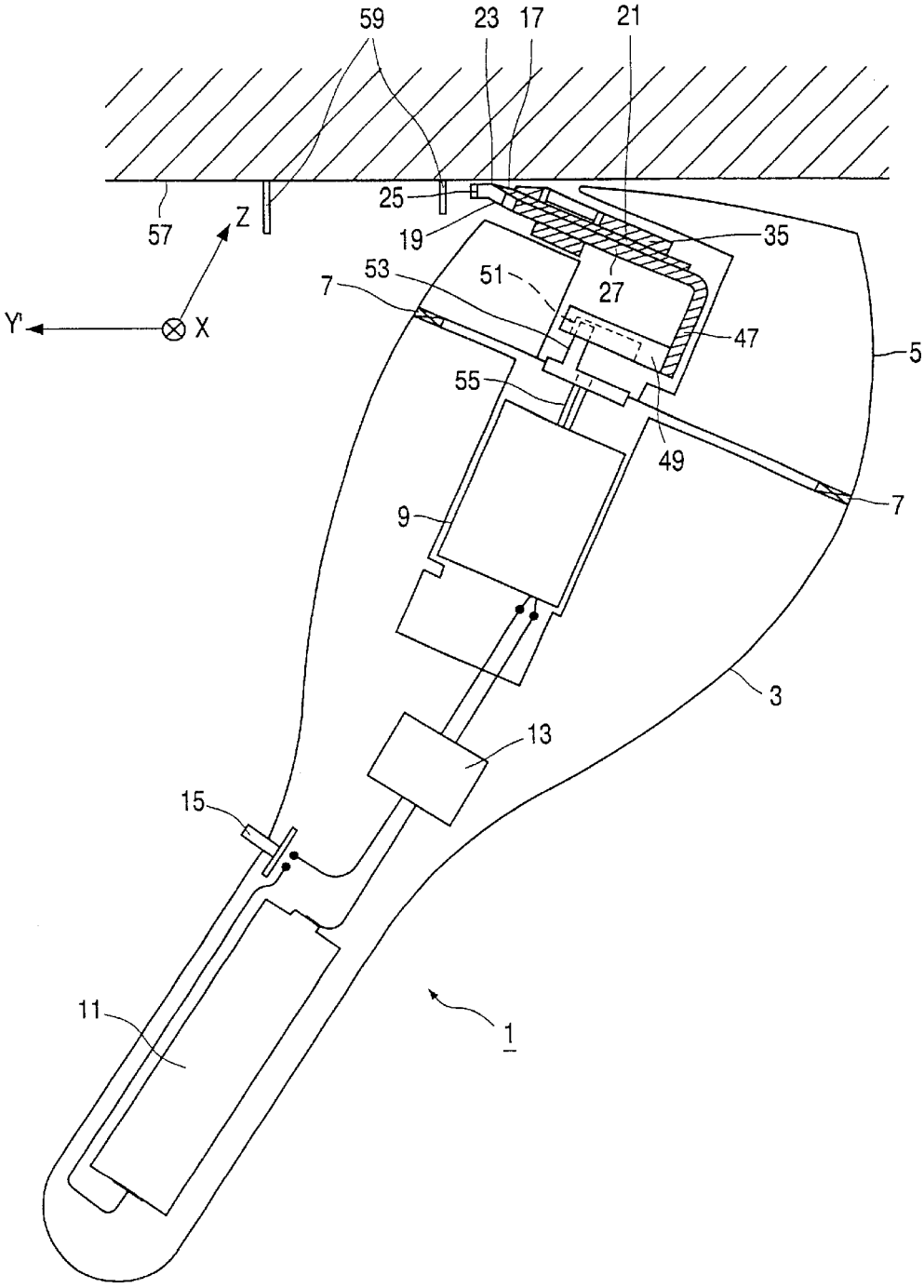

17"
21"
23"
75
27"
71'
65'
67'
25"
19"
61'
73'
29"
Z
Y
X
47"
VII
VII

HAIR REMOVING APPARATUS COMPRISING PLATE-SHAPED CARRIERS WHICH CARE POSITIONED AND MOVABLE WITH RESPECT TO EACH OTHER

The invention relates to a hair removing apparatus comprising two co-operating hair processing members, which can be moved with respect to each other in a direction of movement and include, respectively, a first and a second plate-shaped carrier extending substantially parallel to the direction of movement, said two carriers, viewed parallel to a Z direction extending substantially perpendicularly to the carriers, being positioned with respect to each other by means of at least one positioning member provided with a contact element which engages a side of the second carrier facing away from the first carrier.

The invention also relates to a method of manufacturing a hair removing apparatus in accordance with the invention.

A hair removing apparatus of the type mentioned in the opening paragraph is disclosed in Research Disclosure, no. 591, May 1998, publication no. 40974. The known hair removing apparatus is a hair trimmer, and the two co-operating hair processing members each comprise a plate-shaped carrier, an edge of which extending parallel to the direction of movement is provided with a plurality of spaced apart teeth whose flanks are embodied so as to be cutting edges. The carriers can be moved to and for with respect to each other in the direction of movement as a result of the fact that one of the carriers can be driven, by means of an electric motor, in the direction of movement with respect to the other carrier, which is fixed in position. The carriers, viewed in a direction parallel to the Z direction, are positioned with respect to each other by means of two C-shaped clamping members which, viewed in the direction of movement, are centrally arranged, one leg of each clamping member engaging the side of the second carrier facing away from the first carrier, and the other leg engaging the side of the first carrier facing away from the second carrier. The stiffness of the clamping members is comparatively high. In the manufacture of the hair trimmer, one of the legs of each clamping member is bent by means of a laser adjusting device in such a manner that a desired gap width is obtained between the two carriers.

A drawback of the known hair removing apparatus resides in that, at the desirable gap width, undesirable friction forces between the two carriers in the direction of movement are substantially unavoidable. Such friction forces develop as a result of unavoidable tolerances in the thickness of the carriers. As a result of such tolerances, the facing sides of the carriers are not flat. This causes tolerances in the width of the gap present between the carriers and even contact between the carriers at a number of locations, resulting in comparatively high friction forces. When the carriers are moved with respect to each other, the friction forces may even become so large locally that seizure of the known hair removing apparatus takes place. Said friction forces can be precluded by increasing the average gap width. However, this has the disadvantage that locally the gap width becomes too large, which adversely affects the operation of the hair removing apparatus.

It is an object of the invention to provide a hair removing apparatus of the type mentioned in the opening paragraph, wherein friction forces between the two plate-shaped carriers are limited as much as possible, while a gap width, which is as small and uniform as possible, is still present between the plate-shaped carriers.

To achieve this object, a hair-removing apparatus in accordance with the invention is characterized in that the two carriers, viewed in a direction parallel to the Z direction, are positioned with respect to each other by means of a plurality of positioning members which, viewed in a direction parallel to the direction of movement, are arranged so as to be spaced apart, at least one of the carriers having a comparatively low bending stiffness. The expression "a comparatively low bending stiffness" is to be taken to mean that the relevant carrier has so low a bending stiffness that the side of the relevant carrier facing the other carrier assumes a shape as a result of bending of the relevant carrier which corresponds at least substantially to a shape of the side of the other carrier facing the relevant carrier. The relevant carrier assumes said shape as a result of the fact that the carriers are positioned with respect to each other by means of said plurality of spaced apart positioning members, i.e. At a plurality of locations. As the facing sides of the two carriers are of corresponding shape, the tolerance of the gap width present between the two carriers is comparatively small. As a result, when the two carriers move relatively to each other, local contact between the two carriers is precluded as much as possible, and a comparatively small, uniform gap width between the two carriers is possible without the development of undesirably large friction forces.

A particular embodiment of a hair-removing apparatus in accordance with the invention is characterized in that the positioning members each comprise a tongue, which is cut and bent from the first carrier and provided with the contact element near an end portion, and in that the second carrier, viewed in a direction parallel to the Z direction, is enclosed between the first carrier and the contact elements of the tongues, said tongues extending through at least one opening in the second carrier. As the positioning members are formed from the first carrier in said manner, the number of parts of the hair removing apparatus is limited substantially, so that the hair removing apparatus is of a very simple construction.

A further embodiment of a hair removing apparatus in accordance with the invention is characterized in that the positioning members each comprise a tongue which is cut and bent from a third plate-shaped carrier extending substantially parallel to the direction of movement, and which is provided with the contact element near an end portion, and in that the first and the second carrier, viewed parallel to the Z direction, are enclosed between the third carrier and the contact elements of the tongues, said tongues extending through openings in the first and the second carrier, while at least two of the three carriers have a comparatively low bending stiffness. The third carrier is secured, preferably in a fixed position, to a frame of the hair removing apparatus, so that, in operation, the tongues do not move with respect to the frame as would be the case if the tongues were formed from the first or the second carrier. Dependent upon the design of the hair removing apparatus, such movements may be undesirable. As the tongues are not formed from the first or the second carrier, the first and the second carrier do not have to be suitable for the provision of such tongues, so that the choice of the material and the geometry of the first and the second carrier are not limited.

A still further embodiment of a hair removing apparatus in accordance with the invention is characterized in that one of the carriers is provided with a flanged edge extending substantially perpendicularly with respect to the carriers. In this embodiment, a comparatively high bending stiffness of one of the carriers is provided in a comparatively simple manner, so that the assembly of the carriers has a comparatively high bending stiffness. The other carrier(s) have a comparatively low bending stiffness in this embodiment, so that, when subjected to bending, they assume the shape of the carrier having the comparatively high bending stiffness, a comparatively small, uniform gap width being present between the carriers as well as an acceptable level of friction.

A particular embodiment of a hair removing apparatus in accordance with the invention is characterized in that the tongues are C-shaped or S-shaped. In the manufacture of the hair removing apparatus, C-shaped or S-shaped tongues can be manufactured by means of comparatively simple bending tools, and they are effective and reliable positioning members.

A further embodiment of a hair removing apparatus in accordance with the invention is characterized in that the tongues extend substantially parallel, or substantially perpendicularly, to the direction of movement. If the tongues extend substantially parallel to the direction of movement, the tongues can be given a width, viewed in a direction parallel to a Y direction extending perpendicularly to the direction of movement and the Z direction, which corresponds to a width of the openings in the carrier(s), viewed in a direction parallel to the Y direction. In this manner, the carriers are positioned with respect to each other by means of the tongues also in a direction parallel to the Y direction, so that a simple construction of the hair removing apparatus is provided. If the tongues extend substantially perpendicularly to the direction of movement, a distance between the contact elements of the tongues and the openings is not influenced, in operation, by the mutual movements of the two carriers, so that the tongues may have a limited length.

Yet another embodiment of a hair removing apparatus in accordance with the invention is characterized in that the first and the second carrier, viewed in a direction parallel to a Y direction extending perpendicularly to the Z direction and the direction of movement, are positioned with respect to each other by means of at least two further tongues, which are cut and bent from the first carrier, and which extend substantially without clearance through further openings in the second carrier, viewed in a direction parallel to the Y direction. In this embodiment, the first and the second carriers are positioned with respect to each other in a constructionally simple and practical manner, by means of said further tongues and further openings, in a direction parallel to the Y direction and guided with respect to each other in a direction parallel to the direction of movement.

A particular embodiment of a hair removing apparatus in accordance with the invention is characterized in that the first and the second carrier, viewed in a direction parallel to a Y direction extending perpendicularly to the Z direction and the direction of movement, are positioned with respect to each other by means of at least two further tongues, which are cut and bent from the first carrier, and which extend substantially without clearance through further openings in the first and the second carrier, viewed in a direction parallel to the Y direction. Also in this embodiment, the first and the second carrier are positioned with respect to each other in a constructionally simple and practical manner, by means of said further tongues and further openings, in a direction parallel to the Y direction, and guided with respect to each other in a direction parallel to the direction of movement.

A further embodiment of a hair removing apparatus in accordance with the invention is characterized in that the two co-operating hair processing members comprise, respectively, a cutting member and a hair manipulator, the cutting member being provided with a cutting edge extending parallel to the direction of movement for cutting hairs growing from skin, and the hair manipulator, viewed in a displacement direction of the hair removing apparatus, being arranged in front of the cutting edge for causing a movement of the hairs and the cutting edge with respect to each other in a direction parallel to the cutting edge. In this further embodiment, the hair removing apparatus is a shaver of the type disclosed in EP-B-0 855 256, wherein the hair manipulator comprises, for example, a comb which is arranged parallel to the cutting edge and which comprises teeth extending substantially perpendicularly to the cutting edge. In operation, reciprocating movements of the cutting member and the hair manipulator with respect to each other are generated in a direction parallel to the cutting edge by means of an electric driving device of the shaver, as a result of which the hairs are moved back and forth with respect to the cutting edge during cutting. By virtue thereof, a cutting force necessary for cutting the hairs is limited substantially, so that the shaver combines a very good shaving performance with a very high shaving comfort. In this embodiment of the hair removing apparatus, the invention manifests itself in a particular manner in that the shaving performance, the shaving comfort and the safety of the shaver of the type mentioned above are improved substantially as a result of the comparatively small and uniform gap width and the comparatively low friction between the carriers of the cutting member and the hair manipulator.

A still further embodiment of a hair removing apparatus in accordance with the invention is characterized in that the cutting edge is provided on an edge of the first carrier extending parallel to the direction of movement, while the hair manipulator comprises a plurality of teeth provided at intervals with respect to each other on an edge of the second carrier extending parallel to the direction of movement. By virtue thereof, a constructionally very simple and practical structure of the hair removing apparatus with the cutting member and the hair manipulator is provided.

A particular embodiment of a hair removing apparatus in accordance with the invention, wherein one of the carriers is provided with a flanged edge extending substantially perpendicularly with respect to the carriers, is characterized in that the flanged edge is provided on the second carrier. This embodiment is particularly advantageous in an embodiment wherein the second carrier, which carries the hair manipulator, is driven by means of an electric driving device in a direction parallel to the direction of movement, and wherein the first carrier, which carries the cutting member, is arranged in a fixed position with respect to a frame of the hair removing apparatus. The reason for this being that the flanged edge can be coupled to the driving device in a constructionally simple and practical manner. In addition, a large degree of freedom is provided as regards the choice of the material and the geometry of the cutting member.

A method in accordance with the invention for the manufacture of a hair removing apparatus in accordance with the invention is characterized in that during a first phase the tongues are pre-bent into a predetermined shape, during a second phase the carriers are arranged together and the tongues are provided in the relevant openings, during a third phase the contact elements of the tongues are pressed against the second carrier under the influence of a predetermined pressure, and during a fourth phase the pressure is removed. In said third phase, the tongues are further deformed under the influence of said pressure, and pressed with their contact elements against the second carrier. In this operation, elastic pretension develops in the tongues. The removal of the pressure causes the tongues to spring back elastically. The spring-back distance of the tongues is equal to the gap that forms between the contact elements and the second carrier. The size of the gap is so small that the hair processing members can move with respect to each other substantially free of clearance without hairs entering the gap between the hair processing members. If a small contact pressure between the carriers is desired after all, the tongues are heated in an intermediate phase between the third phase and the fourth phase approximately up to their melting temperature and, viewed across their thickness, in a uniform manner, while the pressure is maintained, and subsequently, after the tongues have cooled at least partly, the pressure is removed. As the pressure is maintained, it is precluded that the tongues spring back under the influence of said pretension. Said pretension disappears as a result of the fact that the tongues are heated. The tongues are heated uniformly, viewed across their thickness, so that substantially no thermal deformation of the tongues takes place during cooling, as a result of which the tongues do not become detached from the second carrier during cooling. When the pressure is being removed in said fourth phase, the assembly of carriers slightly springs back, as a result of which a comparatively small contact force develops between the second carrier and the contact elements of the tongues, and clearance between the second carrier and the contact elements is precluded. The hair removing apparatus thus manufactured has an accurately defined, comparatively small and uniform gap width between the carriers. As the contact forces between the tongues and the second carrier are comparatively small after the manufacturing process, the friction between the carriers is comparatively small.

A particular embodiment of a method in accordance with the invention is characterized in that the tongues are heated by means of a laser beam whose focus is directed at a distance from the tongues. The tongues are rapidly heated by means of the laser beam, so that the manufacturing process of the hair removing apparatus is accelerated. Use can be made of simple means to direct the laser beam to the tongues. As the focus of the laser beam is directed at a distance from the tongues, it is achieved that the tongues, viewed across their thickness, are heated as uniformly as possible, so that undesirable thermal deformations of the tongues during cooling are precluded as much as possible.

A further embodiment of a method in accordance with the invention is characterized in that, between the tongues, an additional pressure is exerted on the second carrier during the third phase and the intermediate phase. As a result of the additional pressure, the assembly of carriers is compressed more strongly during the third and the intermediate phase, so that the assembly also springs back more strongly during the fourth phase, resulting in a larger contact force between the contact elements of the tongues and the second carrier. This further embodiment of the method offers advantages, particularly, if the hair removing apparatus is provided with three carriers, because in such a hair removing apparatus the additional pressure causes clearance between the carriers to be more effectively precluded.

These and other aspects of the invention will be apparent from and elucidated with reference to the embodiment(s) described hereinafter.

Figure 2:
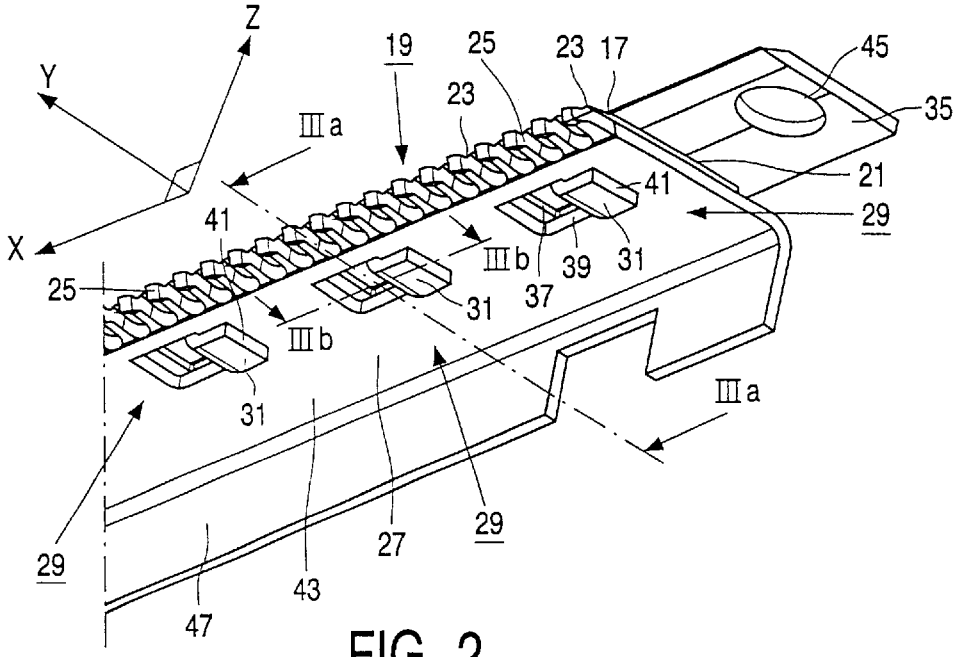
Figure 3A:
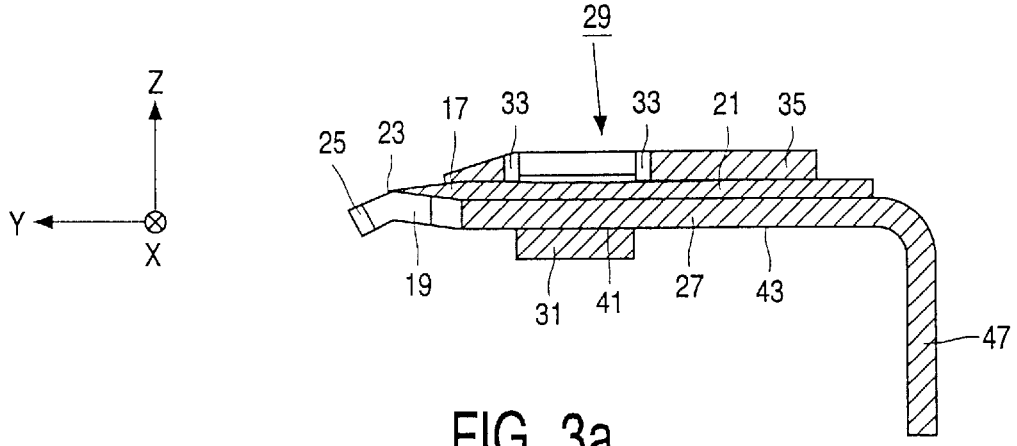
Figure 3B:
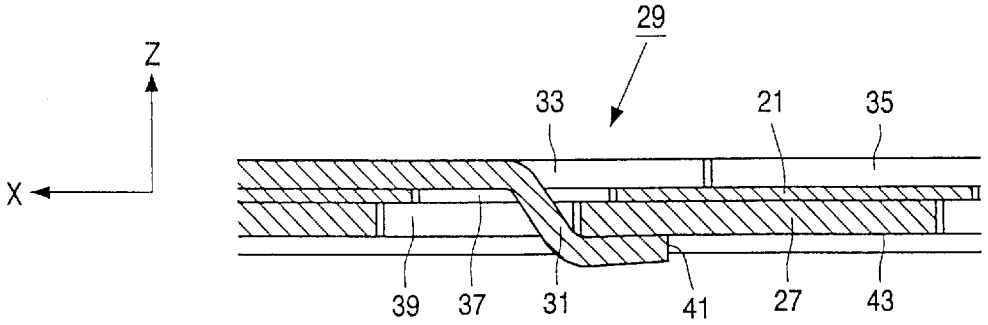
Figure 4:
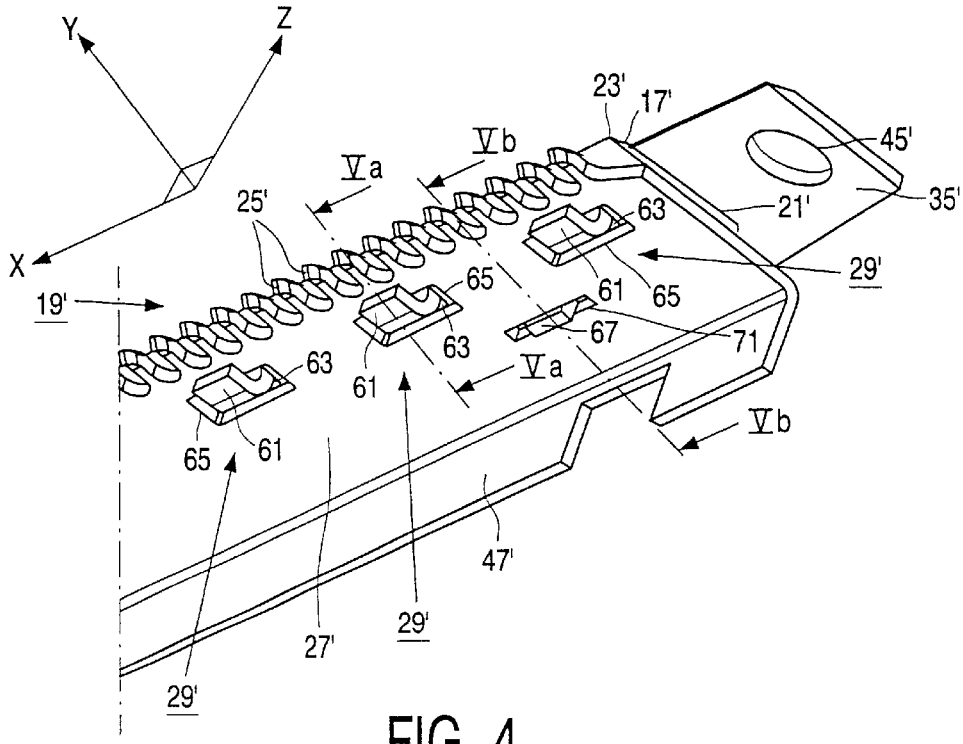
Figure 5A:
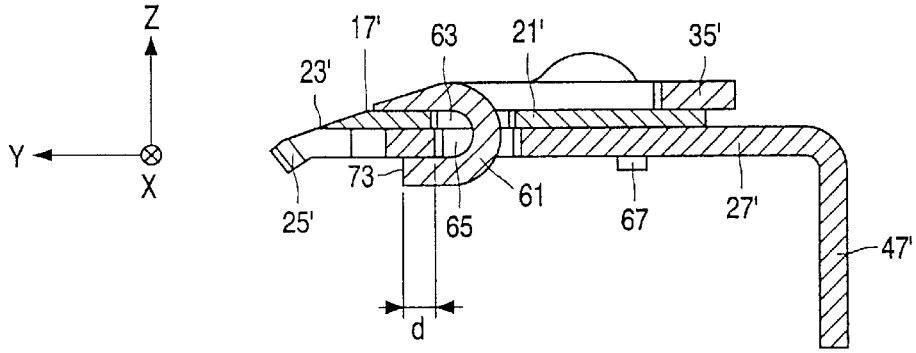
Figure 5B:
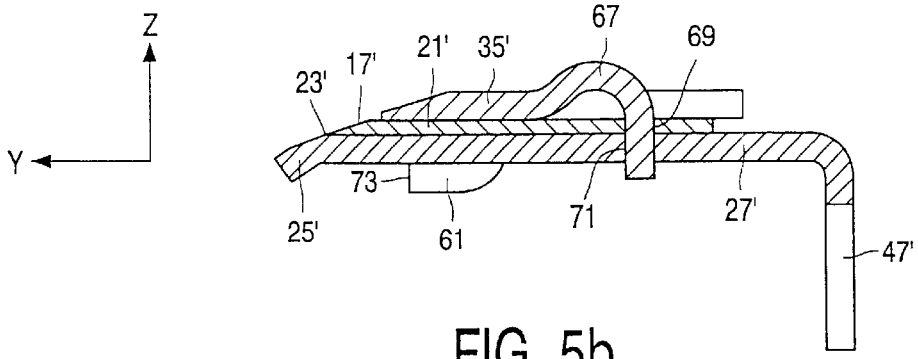
Figures 6A, 6B:
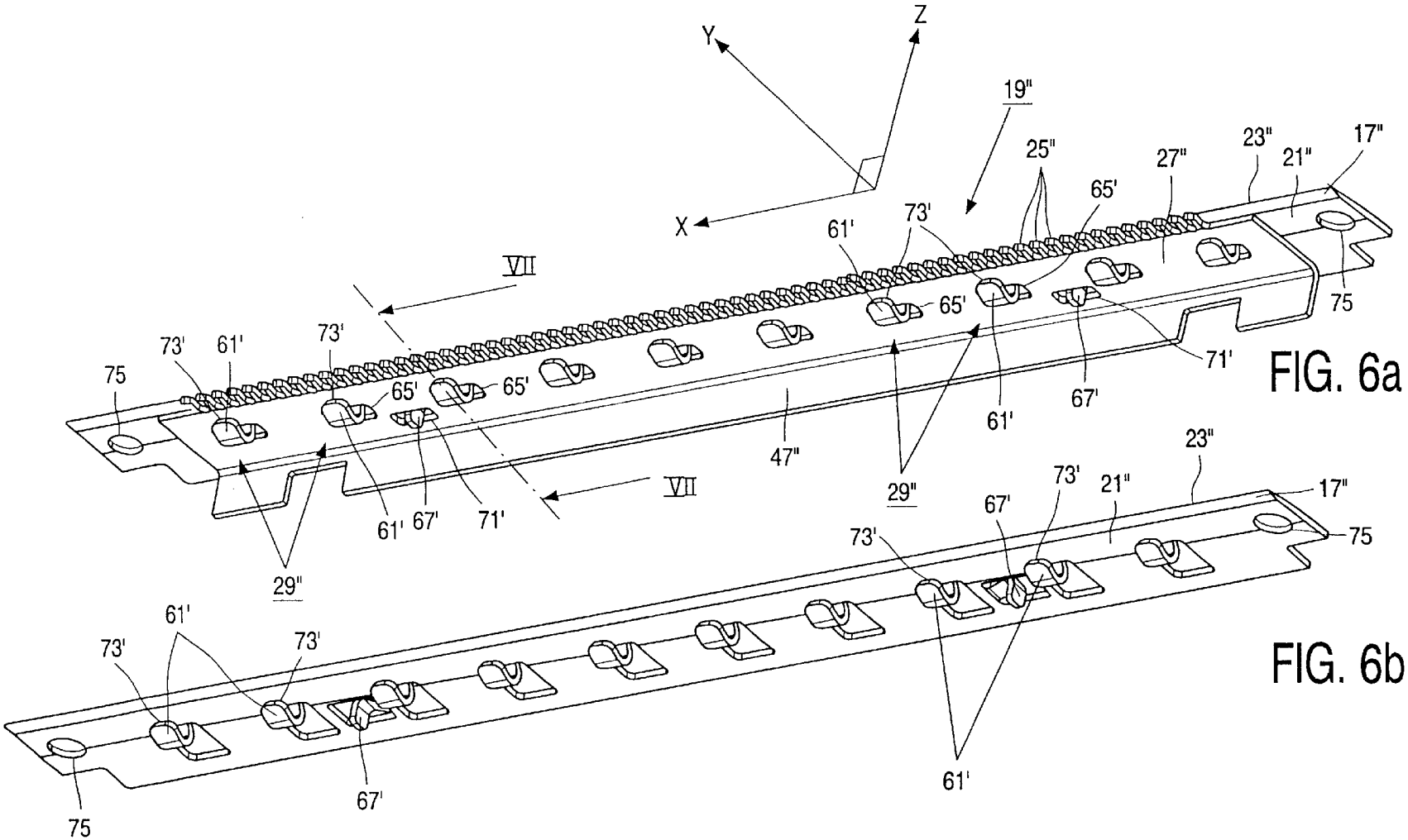

In the drawings:

FIG. 1 is a diagrammatic, cross-sectional view of a first embodiment of a hair removing apparatus in accordance with the invention, FIG. 2 shows a part of an assembly of two co-operating hair processing members and a carrier of the hair removing apparatus in accordance with FIG. 1, FIG. 3*a* is a cross-sectional view taken on the line IIIa—IIIa in FIG. 2, FIG. 3*b* is a cross-sectional view taken on the line IIIb—IIIb in FIG. 2, FIG. 4 shows a part of an assembly of two co-operating hair processing members and a carrier of a second embodiment of a hair removing apparatus in accordance with the invention, FIG. 5*a* is a cross-sectional view taken on the line Va—Va in FIG. 4, FIG. 5*b* is a cross-sectional view taken on the line Vb—Vb in FIG. 4, FIG. 6*a* shows an assembly of two co-operating hair processing members of a third embodiment of a hair removing apparatus in accordance with the invention, FIG. 6*b* shows one of the hair processing members of the assembly in accordance with FIG. 6*a,*

Figure 7:
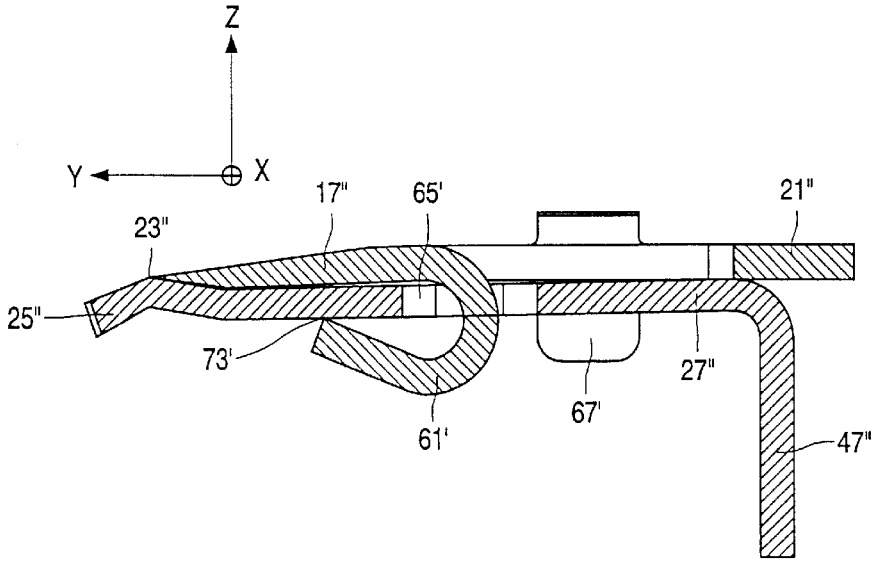

FIG. 7 is a cross-sectional view taken on the line VII—VII in FIG. 6*a,*

FIG. 8*a* through FIG. 8*d* show a fourth embodiment of a hair removing apparatus in the form of a rotating shaver.

Figure 10:
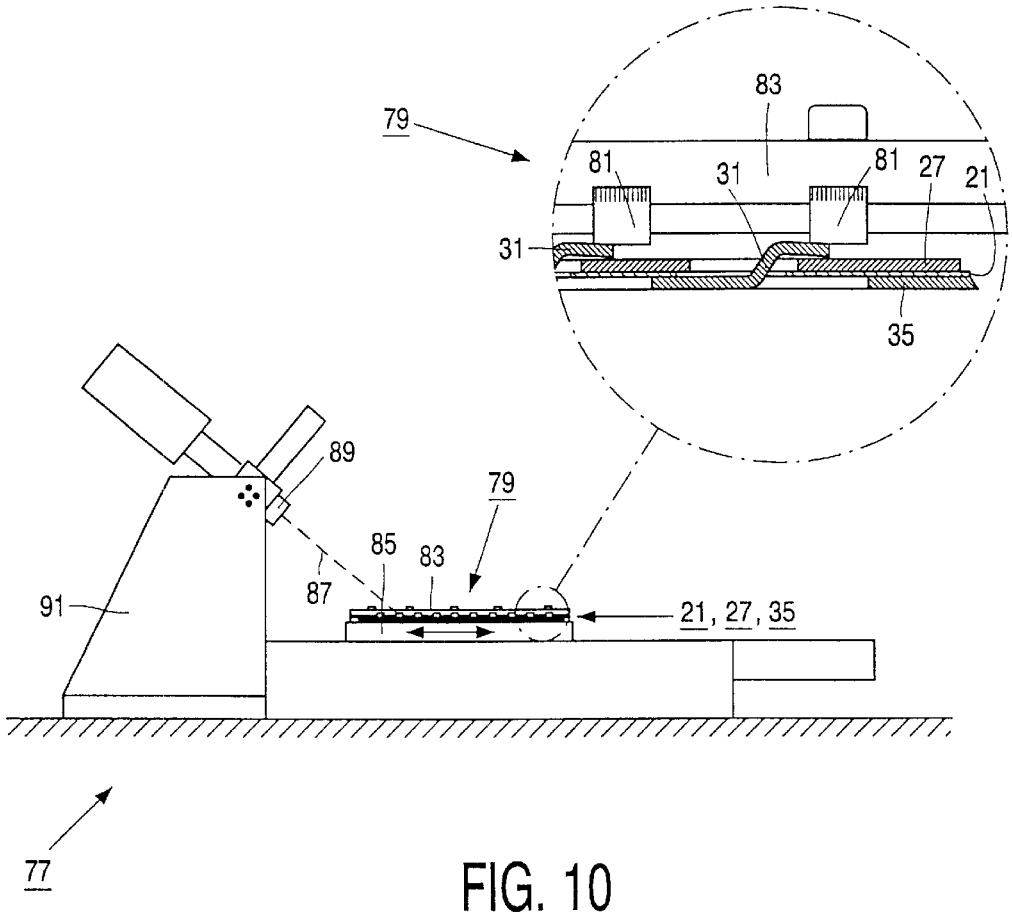
Figure 8A:
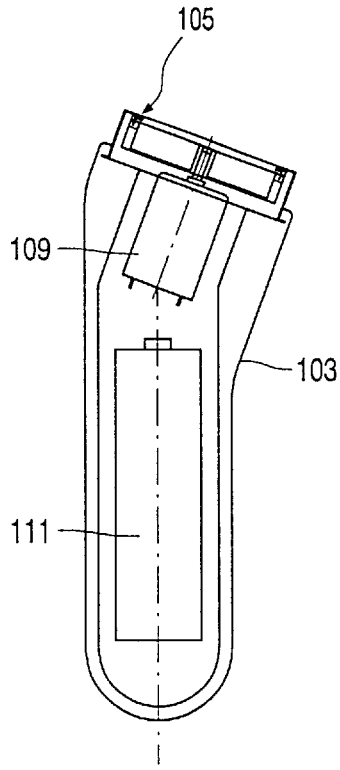
Figure 8B:
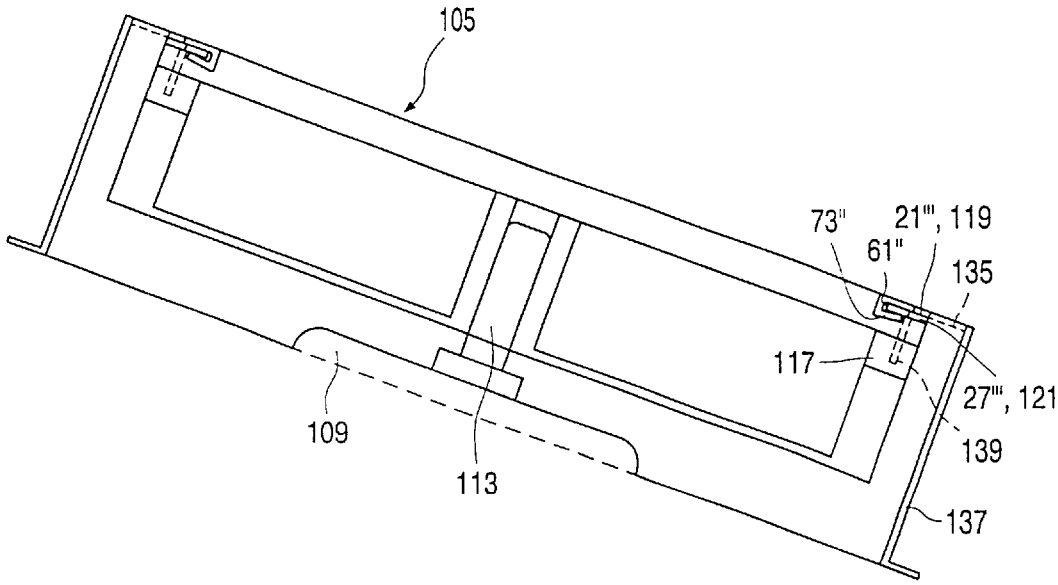
Figure 8C:
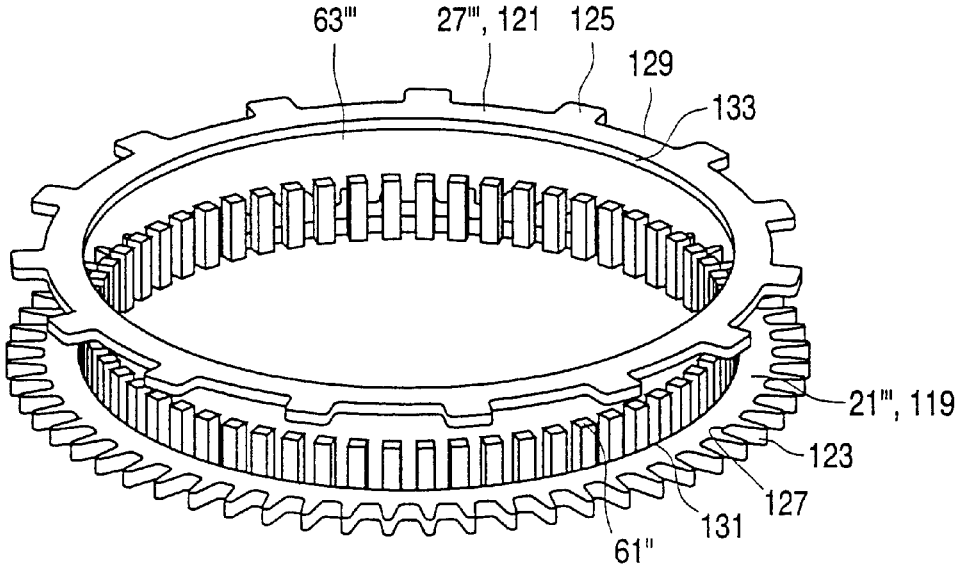
Figure 8D:
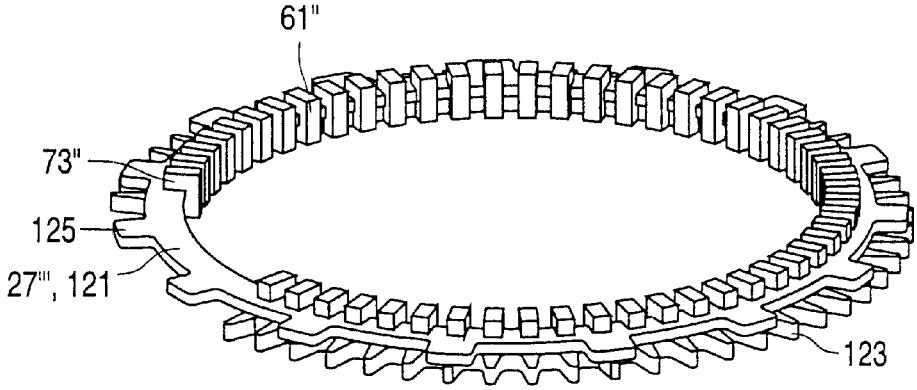

FIG. 9*a* through FIG. 9*d* show a number of successive phases of a method in accordance with the invention for the manufacture of a hair removing apparatus in accordance with the invention, and FIG. 10 diagrammatically shows a device for carrying out a method in accordance with the invention.

The first embodiment of a hair removing apparatus in accordance with the invention, as shown in FIG. 1, is a shaver 1 comprising a housing 3 onto which a shaving head 5 is detachably secured by means of securing means 7 which, for the sake of simplicity, are only diagrammatically shown in FIG. 1 and may be of a type that is known per se and commonly used. The housing 3 accommodates an electric motor 9, a battery 11 for energizing the motor 9 and an electric controller 13 for controlling the motor 9. The motor 9 can be switched on and off by means of a switch 15 provided on the housing 3.

In the shaving head 5, two co-operating hair processing members are arranged comprising, respectively, a cutting member 17 and a hair manipulator 19. The assembly of cutting member 17 and hair manipulator 19 is shown in detail in FIG. 2. The co-operating hair processing members can be moved with respect to each other, in a manner which will be described in greater detail hereinbelow, in a direction parallel to the direction of movement X shown in FIG. 1 and FIG. 2. The cutting member 17 comprises a first plate-shaped metal carrier 21, which extends substantially perpendicularly to a Z direction, shown in FIG. 1 and FIG. 2, which extends perpendicularly to the X direction. The cutting member 17 has a cutting edge 23, which is provided on an edge of the first carrier 21 extending parallel to the X direction, which cutting edge is used to cut hairs growing from skin. Viewed in a displacement direction Y' wherein the shaver must be moved over the skin, the hair manipulator 19 is arranged directly in front of the cutting edge 23 and comprises a comb having a plurality of teeth 25 which are arranged at a distance from each other on an edge of a second metal plate-shaped carrier 27 extending parallel to the X direction, said second metal plate-shaped carrier also extending substantially perpendicularly to the Z direction. As shown in FIG. 2, the first carrier 21 and the second carrier 27, viewed in a direction parallel to the Z direction are positioned with respect to each other by means of a plurality of positioning members 29 which, viewed in a direction parallel to the X direction, are arranged at regular distances from each other. The positioning members 29 each comprise an S-shaped metal tongue 31 which extends substantially parallel to the X direction. As shown in FIG. 3*a* and FIG. 3*b*, the tongue 31 is formed by providing incisions 33 in a third metal carrier 35 extending, just like the first carrier 21 and the second carrier 27, substantially perpendicularly to the Z direction. The first carrier 21, the second carrier 27 and the third carrier 35 jointly form an assembly, wherein the first carrier 21 is arranged between the second carrier 27 and the third carrier 35. The tongues 31 are bent from the third carrier 35 and extend through the openings 37 formed in the first carrier 21 and through openings 39 formed in the second carrier 27. An end portion of each tongue 31 forms a contact element 41 with which the tongue 31 engages a side 43 of the second carrier 27 facing away from the first carrier 21. As the first carrier 21 and the second carrier 27 are thus enclosed between the third carrier 35 and the contact elements 41 of the tongue 31, viewed in a direction parallel to the Z direction, the first carrier 21 and the second carrier 27, viewed in a direction parallel to the Z direction, are positioned with respect to each other and with respect to the third carrier 35 by means of the tongues 31. As shown in FIG. 2, the openings 37 and 39 have a width which, viewed in a direction parallel to an Y direction extending perpendicularly to the X direction and perpendicularly to the Z direction, which substantially corresponds to a width of the tongues 31, so that, viewed in a direction parallel to the Y direction, the tongues 31 extend through the openings 37 and 39 substantially without clearance. As a result, the first carrier 21 and the second carrier 27 are positioned, viewed also parallel to the Y direction, with respect to each other and with respect to the third carrier 35 by means of the tongues 31. Furthermore, in the example shown, the first carrier 21 carrying the cutting member 17 is secured to the third carrier 35 by means of, for example, a single laser welded joint, so that, in the assembly of the first carrier 21, the second carrier 27 and the third carrier 35, only the second carrier 27 carrying the hair manipulator 19 can be moved with respect to the first carrier 21 and the third carrier 35 in a direction parallel to the X direction.

The assembly of the two co-operating hair processing members and the third carrier 35 is secured in the shaving head 5 of the shaver 1 by means of two securing members, not shown in FIGS. 1 and 2, which are provided through two securing holes 45 proximate to the two end portions of the third carrier 35. It is to be noted that, in FIG. 2, only one of the two securing holes 35 is visible. The cutting member 17 is thus arranged in a fixed position in the shaving head 5. As shown in FIG. 2, the second carrier 27 is provided with a flanged edge 27 extending substantially perpendicularly to the carriers 21, 27, 35. As diagrammatically shown in FIG. 1, a coupling member 49 is provided on the flanged edge 47, which coupling member is provided with a slot 51 extending parallel to the Y direction. The slot 51 is in engagement with a driving pin 53 which, viewed in a direction parallel to the X direction, fits in the slot 51 substantially without clearance and is eccentrically arranged on an outgoing shaft 55 of the motor 9. The second carrier 27 with the hair manipulator 19 can thus be reciprocated, in operation, by means of the motor 9 with respect to the cutting member 17 in a direction parallel to the X direction, i.e. parallel to the cutting edge 23. When a user moves the shaving head 5 over the skin 57 in the displacement direction Y', the hairs 59 are first caught between the teeth 25 of the hair manipulator 19. The spacing between the teeth 25 is comparatively small, so that, by means of the hair manipulator 19, reciprocating movements of the hairs 59 situated between the teeth are generated in a direction substantially parallel to the cutting edge 23, and the hairs 59 are moved back and forth during cutting along the cutting edge 23. As a result, a cutting force which is necessary in the displacement direction Y' for cutting the hairs 59 is limited substantially, so that the shaving performance and the shaving comfort of the shaver 1 are at a high level. The hair manipulator 19 also protects the skin 57 against lesions and skin irritations because the skin 57 is stretched by the teeth 25 directly in front of the cutting edge 23 in a direction parallel to the displacement direction Y', so that comparatively large skin folds in front of the cutting edge 23, wherein lesions could occur, are largely precluded. The reciprocating movements of the hair manipulator 19 also cause the skin 57 directly in front of the cutting edge 23 to be stretched in a direction parallel to the cutting edge 23, as a result of which also comparatively small skin folds between the teeth 25, wherein smaller lesions or skin irritations could occur, are largely precluded.

To ensure that the above-described shaver 1 operates in a reliable and safe manner, a comparatively small, uniform gap width and a comparatively low friction between the first carrier 21 and the second carrier 27 are required. In accordance with the invention, these requirements are met in that the two carriers 21 and 27, viewed in a direction parallel to the Z direction, are positioned with respect to each other by means of the above-mentioned plurality of positioning members 29, and in that at least one of the two carriers 21 and 27 has a comparatively low bending stiffness. It is to be noted that the expression "a comparatively low bending stiffness" is to be taken to mean that the bending stiffness of the relevant carrier is such that the side of the relevant carrier facing the other carrier assumes a shape, as a result of bending of the relevant carrier, which substantially corresponds to a shape of the side of the other carrier facing the relevant carrier. As the two carriers 21, 27 are positioned with respect to each other by means of said plurality of positioning members 29, the carrier having the comparatively low bending stiffness follows the contours of the other carrier at the location of the gap between the two carriers 21, 27. In the example shown in FIG. 1 and FIG. 2, the second carrier 27 has a comparatively high bending stiffness as a result of the flanged edge 47, and the first carrier 21 has a comparatively low bending stiffness. In this example, a sufficiently low bending stiffness of the first carrier 21 is achieved by manufacturing the first carrier 21 from stainless steel with an E-modulus of approximately 2.105 $N/mm^2$ with a plate thickness of approximately 0.1 mm. The length of the first carrier 21 is approximately 30 mm, viewed in a direction parallel to the X direction. In this example, the second carrier 27 is also made from stainless steel with a plate thickness of approximately 0.2 mm. In this example, also the third carrier 35 must have a comparatively low bending stiffness because the third carrier 35 must not obstruct bending of the second carrier 27. Therefore, the third carrier 35 is also made from stainless steel with a plate thickness of also approximately 0.1 mm. In this example, viewed over said length of the first carrier 21, 10 positioning members 29 are provided at a mutual distance of approximately 2.5 mm. As the first carrier 21 thus follows the contours of the second carrier 27 as best it can, at the location of the gap between the two carriers 21, 27, the influence of roughnesses in the facing sides of the two carriers 21, 27 and of tolerances in plate thickness of the carriers 21, 27 on the gap width between the two carriers 21, 27 are limited as much as possible, resulting in a gap width that is as uniform as possible between the carriers 21, 27, also in the case of a comparatively small gap width as is desired for a satisfactory and safe operation of the shaver 1. As a result of the uniform gap width, local contact forces in the gap between the two carriers 21, 27 are limited as much as possible, as a result of which also friction forces between the two carriers 21, 27 are limited as much as possible. It is to be noted that a gap width which is as uniform as possible between the first carrier 21 and the second carrier 27 is also achieved in an alternative embodiment wherein all carriers 21, 27, 35 have a comparatively low bending stiffness. In such an embodiment, the assembly of carriers 21, 27, 35 has a comparatively high capability of following local skin contours. A gap width which is as uniform as possible between the first carrier 21 and the second carrier 27 is generally achieved if at least two of the three carriers 21, 27, 35 have a comparatively low bending stiffness, i.e. if no more than one of the three carriers 21, 27, 35 has a comparatively high bending stiffness. The advantage of the above-described first embodiment, wherein the second carrier 27 to be moved has a comparatively high bending stiffness, resides in that the flanged edge 47 enables the coupling to the motor 9, which is necessary for the second carrier 27, to be carried out in a constructionally simple and practical manner. The use of the stationary third carrier 35 has the advantage for the positioning members 29 that said positioning members 29 are arranged in a stationary position in the shaving head 5, while the choice of the material and geometry of the first carrier 21 and the second carrier 27 are not limited because these carriers 21, 27 do not have to be suitable for the provision of the tongues 31.

FIGS. 4, 5*a* and 5*b* show an assembly of three carriers 21', 27', 35' in a second embodiment of a hair removing apparatus in accordance with the invention. In FIGS. 4, 5*a* and 5*b*, parts of the relevant assembly, which correspond to parts of the assembly shown in FIGS. 2, 3*a* and 3*b* and used in the first embodiment, are indicated by means of corresponding reference numerals. Hereinbelow, only a number of differences between the first and the second embodiment are discussed.

As shown in FIGS. 4 and 5*a*, the positioning members 29' in the second embodiment each comprise a C-shaped tongue 61 extending substantially perpendicularly to the X direction and substantially parallel to the Y direction. Viewed in a direction parallel to the X direction, the tongues 61 extend substantially without clearance through openings 63 in the first carrier 21', so that the first carrier 21' is also positioned in a direction parallel to the X direction with respect to the third carrier 35' by means of the tongues 61. Viewed in a direction parallel to the X direction, the tongues 61 extend with ample clearance through openings 65 in the second carrier 27', so that the second carrier 27' can be moved, with respect to the first carrier 21' and the third carrier 35', in a direction parallel to the X direction. Viewed in a direction parallel to the Y direction, the first carrier 21' and the second carrier 27' are positioned with respect to each other and with respect to the third carrier 35' by means of two further tongues 67, which, just like the tongues 61, are formed by incisions in the third carrier 35' and are bent from the third carrier 35'. Viewed in a direction parallel to the Y direction, the further tongues 67 thus extend, substantially without clearance, see FIG. 5*b*, through further openings 69 in the first carrier 21' and through further openings 71 in the second carrier 27'. It is to be noted that in FIG. 4 only one of the two further tongues 67 is shown. As the tongues 61 extend parallel to the Y direction, i.e. perpendicularly to the X direction, a distance d, as shown in FIG. 5*a*, between the contact elements 73 of the tongues 61 and the openings 63, 65 is not influenced by the movements made by the second carrier 27', in operation, with respect to the third carrier 35' and the tongues 61 in a direction parallel to the X direction. For this reason, the length of the tongues 61 does not have to be adapted to the stroke of the movement of the second carrier 27', so that said length can be limited. As the further tongues 67 are formed from the third carrier 35', as are the tongues 61, the first carrier 21' and the second carrier 27' are positioned with respect to each other in a direction parallel to the Y direction and guided with respect to each other in a direction parallel to the X direction by means of the further tongues 67 in a constructionally simple and practical manner.

FIGS. 6*a*, 6*b* and 7 show an assembly of two co-operating hair processing members in a third embodiment of a hair removing apparatus in accordance with the invention. In FIGS. 6*a*, 6*b* and 7, parts of the relevant assembly corresponding to parts of the embodiment shown in FIGS. 4, 5*a* and 5*b* and applied in the second embodiment are indicated by means of corresponding reference numerals. Hereinbelow, only a number of differences between the second and the third embodiment are discussed.

The assembly employed in the third embodiment differs mainly from the assemblies used in the first and the second embodiment in that in the assembly used in the third embodiment the third carrier 35, 35', as used in the first and the second embodiment, is absent. The positioning members 29" used in the third embodiment comprise tongues 61' and further tongues 67' which correspond to the tongues 61 and further tongues 67 as used in the second embodiment, but are formed by incisions in the first carrier 21' and are bent from the first carrier 21'. As a result, viewed in a direction parallel to the Z direction, the second carrier 27" is enclosed between the first carrier 21" and the contact elements 73' of the tongues 61'. The tongues 61' extend, viewed in a direction parallel to the X direction, with ample clearance through openings 65' in the second carrier 27", so that the second carrier 27" can be moved with respect to the first carrier 21" in a direction parallel to the X direction. Viewed in a direction parallel to the Y direction, the further tongues 67' extend substantially without clearance through further openings 71' in the second carrier 27", so that the second carrier 27", viewed in a direction parallel to the Y direction. The assembly of the first carrier 21" and the second carrier 27" is secured in the shaving head of the shaver in accordance with the invention by means of two securing members, not shown in FIGS. 6*a*, 6*b* and 7, which are provided through two securing holes 75 situated near the two end portions of the first carrier 21'. The cutting member 17" is thus arranged in a fixed position in the shaving head, just like in the first and the second embodiment. The hair manipulator 19" can be moved back and forth in a direction parallel to the X direction with respect to the cutting member 17" in a manner as used for the hair manipulator 19 in the first embodiment. As the third carrier 35, 35' used in the first and the second embodiment is absent in the third embodiment, the number of parts of the hair removing apparatus is limited and the structure of the hair removing apparatus is simplified. In the third embodiment, the second carrier 27" has a comparatively high bending stiffness owing to the presence of the flanged edge 47", while the first carrier 21" has a comparatively low bending stiffness. It is to be noted that in such an embodiment comprising only two carriers only one of the two carriers must have a comparatively low bending stiffness. The invention thus also comprises embodiments including only two carriers which both have a comparatively low bending stiffness.

In the above-described examples of a hair removing apparatus in accordance with the invention, the hair removing apparatus is a shaver wherein the two cooperating hair processing members comprise, respectively, a cutting member and a hair manipulator. It is to be noted that the invention also includes other types of hair removing apparatus, such as rotating shavers or hair trimmers wherein the two cooperating hair processing members are each provided with an edge having a plurality of juxtaposed teeth the flanks of which are embodied so as to be cutting edges. FIGS. 8*a* through 8*d* diagrammatically show an example of a rotating shaver 101 comprising a housing 103 on which a shaving head 105 is provided. Said shaving head 105 accommodates the hair processing members, the first carrier 21''' of which being a stationary cutting member 119 and the second carrier 27''' being a cutting member 121 which can be rotated with respect to the first cutting member. Both cutting members are ring-shaped and are each provided, at the outer edge 127 and 129, respectively, with substantially radially outwardly directed, cooperating cutting elements 123 and 125, respectively. The stationary cutting member 119 is provided at the inner edge 131 with a number of tongues 61'' which are bent around an inner edge 133 of the rotating cutting member 121 by means of the method in accordance with the invention. The rotating cutting member 121 may have, for example, a low bending stiffness. The stationary cutting member 119 is provided with a few fastening lugs 135 by means of which the stationary cutting member is secured to a bearing ring 137 of the shaving head 105. For driving the rotating cutting member 121, said cutting member is provided with a few drive lugs 139. The housing 103 of the shaver accommodates a motor 109 which is powered by, for example, a battery 111. A drive ring 115 is secured on the shaft 113 of the motor, which drive ring is provided with a number of coupling elements 117 which can be coupled to the drive lugs 139 of the rotating cutting member 121.

The cutting members 119, 121 are manufactured by punching rings from a flat metal sheet, which rings form the carriers 21''' and 27''', the tooth-shaped cutting elements 123, 125 being formed, in said punching operation, at the outer edge 127, 129 of each ring. In this punching operation, the first carrier 21''' (stationary cutting element 119) is also provided at the inner edge 131 with radially inwardly directed tongues 61''. These tongues are subsequently bent at right angles, resulting in the situation shown in FIG. 9*c*. The second carrier 27''' (rotating cutting member 121) is positioned on the first carrier 21''' in such a way that the tongues 61'' project through the central opening 63'' of the first carrier 21''. The second carrier 27''' accurately fits over the row of tongues 61'' bent at right angles. In the next phase, the tongues are bent further so that the contact elements 73'' of the tongues are pressed against the second carrier 27'''. This can be achieved without heating the tongues. When the pressure is removed, the second carrier 27''' (rotating cutting member 121) is situated, with a very slight amount of clearance, between the contact elements 73'' of the tongues 61'' and the surface 141 of the first carrier 21''' (stationary cutting element 119).

Figure 9A:
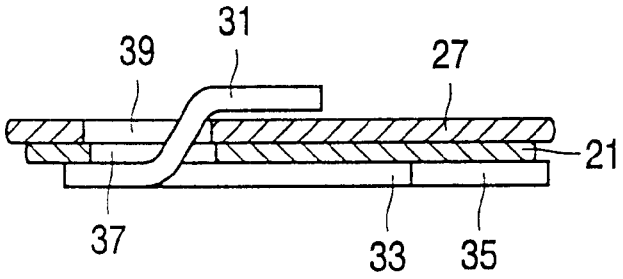
Figure 9B:
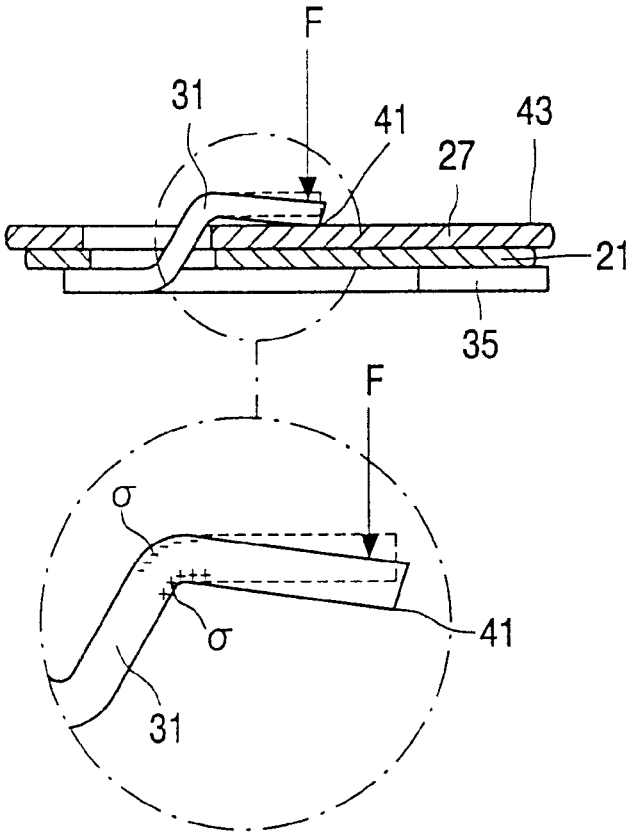
Figure 9C:
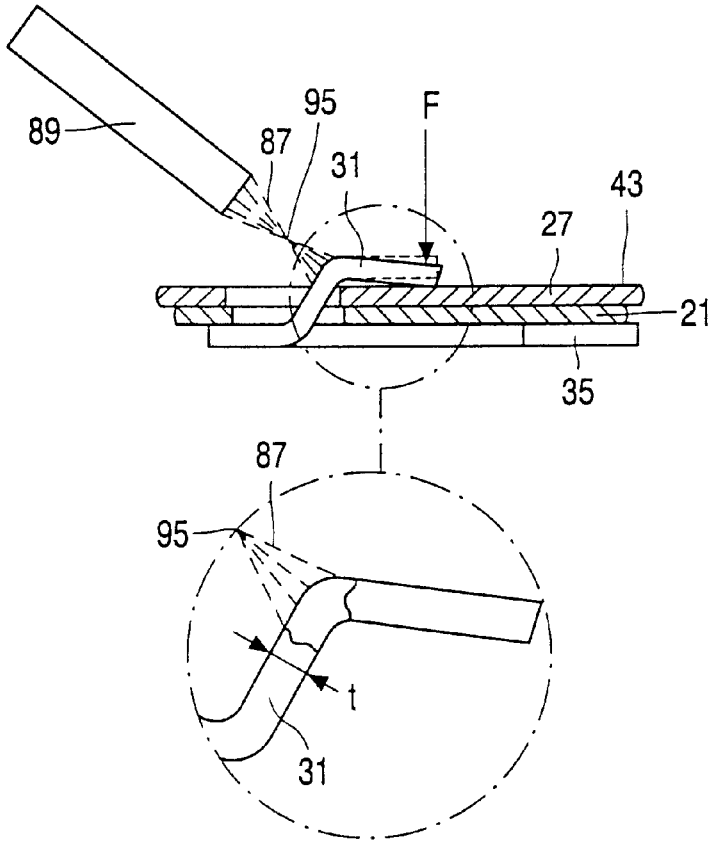
Figure 9D:
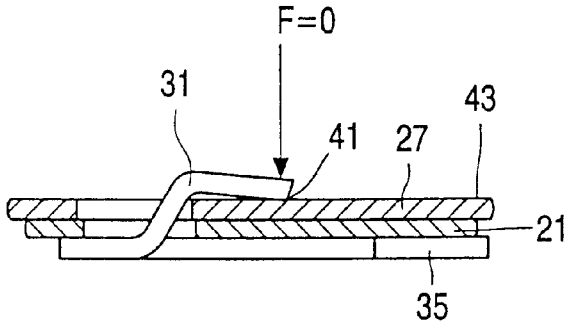

FIGS. 9*a* through 9*d* show a number of successive phases of a method in accordance with the invention, by means of which the assembly of the first carrier 21, second carrier 27 and third carrier 35 of the above-described first embodiment of a hair removing apparatus in accordance with the invention can be manufactured. It is to be noted that other embodiments of the assembly of co-operating hair processing members, inter alia embodiments comprising only two carriers, such as the above-discussed assembly of carriers 21'' and 27'' used in the third embodiment of a hair removing apparatus in accordance with the invention, can be manufactured in a similar manner. FIG. 9*a* shows the assembly of three carriers 21, 27 and 35 after a first phase and a second phase, not shown, of the method in accordance with the invention. During said first phase, the tongues 31 are formed on the third carrier 35 in a manner which is known per se and commonly used, by providing the incisions 33 in the third carrier 35, for example by means of a laser cutting process which is known per se and commonly used, and the tongues 31 thus formed are bent from the carrier 35 in a manner which is known per se and commonly used, and prebent in a predetermined form, in the example shown the desired S-shape, for example by means of a stamping process which is known per se and commonly used. It is to be noted that the tongues 31 can also be cut from the third carrier 35 and bent by means of a different process, for example by means of a cutting and bending process which is known per se and commonly used, wherein the tongues 31 are simultaneously cut and bent from the third carrier 35 by means of a cutting and bending tool. In said second phase, the assembly of three carriers 21, 27 and 35 is composed by passing the tongues 31 through the openings 37 in the first carrier 21 and through the openings 39 in the second carrier 27. This can be carried out, for example, by means of a suitable automatic assembly or stacking machine. FIG. 9*b* shows the assembly of three carriers 21, 27 and 35 during a third phase of the method, wherein the contact elements 41 of the tongues 31 are pressed against the side 43 of the second carrier 27 facing away from the first carrier 21 under the influence of a predetermined pressure F. This can be carried out, for example, by means of a device 77, diagrammatically shown in FIG. 10, which is provided with a pressure member 79 comprising a number of pressure elements 81 corresponding to the number of tongues 31. The pressure elements 81 are provided on a common carrying member 83 on which the pressure F is exerted using means, not shown in FIG. 10 for the sake of simplicity, which are known per se and commonly used. The assembly of three carriers 21, 27 and 35 is held down to a table 85 of the device 77 using means, not shown in FIG. 10 for the sake of simplicity, which are known per se and commonly used. As the tongues 31 are bent under the influence of the pressure F during the third phase, bending stresses $\sigma$ develop in the tongues 31 under the influence of which the tongues 31 partly bend back if the pressure F would be removed after the third phase. In order to preclude said bending back of the tongues 31, the tongues 31 are heated during an intermediate phase of the method shown in FIG. 9*c* up to approximately their melting temperature, as a result of which said bending stresses disappear from the tongues 31. During heating and cooling of the tongues 31, the pressure F is maintained, so that the positions of the tongues 31 against the second carrier 27 are maintained. In the example shown, the tongues 31 are heated by means of a laser beam 87 generated by a laser source 89 of the device 77, which is diagrammatically shown in FIG. 9*c* and FIG. 10. The laser source 89 is successively directed at the successive tongues 31 of the assembly to be manufactured by moving the table 85 step-by-step with respect to a base 91 of the device 77 in a direction indicated by means of an arrow in FIG. 10. As is diagrammatically shown in FIG. 9*c*, the laser beam 87 is focused such that a focus 95 of the laser beam 87 is situated at a distance from the tongue 31 to be heated. In this manner, it is achieved that the tongues 31, viewed across their thickness t, are uniformly heated through and through, thereby precluding as much as possible that bending stresses can develop again in the tongues 31 during cooling of the tongues 31 under the influence of which the tongues 31 would bend after removal of the pressure F and become detached from the second carrier 27. By means of the laser beam 87, the tongues 31 are heated to the desired temperature in a comparatively short period of time, so that the manufacturing process is accelerated. FIG. 9*d* shows the assembly of three carriers 21, 27 and 35 during a fourth phase of the method, wherein the pressure F is removed after the tongues 31 have cooled at least partly. In the example shown, the cooling of the tongues 31 takes place by natural heat conduction via the tongues 31 and the three carriers 21, 27, 35, but in an alternative embodiment of the method not shown in the Figures, cooling of the tongues 31 can be accelerated by providing the device 77 with additional means for cooling the tongues 31. As the assembly of three carriers 21, 27, 35 is slightly compressed in the preceding phases under the influence of the pressure F, the assembly slightly springs back when the pressure F is removed in the fourth phase. As a result, a comparatively small contact force remains between the contact elements 41 of the tongues 31 and the second carrier 27 after the fourth phase. By virtue of said contact force, an undesirable clearance between the tongues 31 and the second carrier 27 and between the carriers 21, 27 and 35 is precluded as much as possible. As said contact force is comparatively small, the contact force does not lead to undesirably high friction forces between the three carriers 21, 27, 35. The contact force between the second carrier 27 and the contact elements 41 of the tongues 31 is increased in a particular embodiment of a method of manufacturing the assembly, not shown in the Figures, by exerting an additional pressure, between the successive tongues 31, on the second carrier 27 during the above-mentioned third and intermediate phases of the method. This can be carried out by means of additional pressure elements provided on the carrier member 83 between the pressure elements 81, or by means of additional pressure elements arranged on an individually movable further carrier member of the device 77. As the assembly of carriers 21, 27, 35 is compressed to a substantial degree under the influence of the additional pressure, the assembly also springs back to a stronger degree after removing the pressure F and the additional pressure, so that a larger contact force remains between the second carrier 27 and the contact elements 41 of the tongues 31. A larger contact force is advantageous, in particular, in the case of assemblies comprising three or more carriers, because in such assemblies the risk of an undesirably large clearance between the tongues and the second carrier or between the carriers is larger than in assemblies comprising only two carriers.

In the example of the method in accordance with the invention shown in FIG. 9*a* through FIG. 9*d*, the tongues 31 are prebent in said first phase into the ultimately desired shape and measure. It is to be noted that, in an alternative embodiment of the method, the tongues 31 can be prebent in a different manner. For example, the tongues 31 can be prebent in a position wherein they extend substantially perpendicularly to the carrier 35, as a result of which the prebending of the tongues 31 in the first phase is simplified. It is further to be noted that the invention also comprises embodiments of the method wherein the tongues 31 are heated in a different manner during the intermediate phase, for example by means of an electric current passing through the tongues.

It is to be noted that a hair removing apparatus in accordance with the invention may be provided, instead of the above-mentioned positioning members having C-shaped or S-shaped tongues, with a different type of positioning members, for example positioning members having a bush-shaped part, a flanged edge of which forms the contact element.

What is claimed is:

1. A hair removing apparatus comprising two co-operating hair processing members, which can be moved with respect to each other in a direction of movement and include, respectively, a first plate-shaped carrier and a second plate-shaped carrier extending substantially parallel to the direction of movement, said two carriers, viewed parallel to a Z direction extending substantially perpendicularly to the carriers, being positioned with respect to each other by means of at least one positioning member provided with a contact element which engages a side of the second carrier facing away from the first carrier, characterized in that the two carriers, viewed in a direction parallel to the Z direction, are positioned with respect to each other by means of a plurality of positioning members which, viewed in a direction parallel to the direction of movement, are arranged so as to be spaced apart, and at least one of the carriers has a comparatively low bending stiffness, the positioning members each comprise a tongue, which is cut and bent from a third plate-shaped carrier extending substantially parallel to the direction of movement and which is provided with the contact element near an end portion, the first carrier and the second carrier, viewed parallel to the Z direction, are enclosed between the third carrier and the contact elements of the tongues, said tongues extending through openings in the first carrier and second carrier, and at least two of the three carriers have a comparatively low bending stiffness.

2. A hair removing apparatus as claimed in claim 1, characterized in that one of the carriers is provided with a flanged edge extending substantially perpendicularly with respect to the carriers.

3. A hair removing apparatus as claimed in claim 1, characterized in that the tongues are C-shaped or S-shaped.

4. A hair removing apparatus as claimed in claim 1, characterized in that the tongues extend substantially parallel, or substantially perpendicularly, to the direction of movement.

5. A hair removing apparatus as claimed in claim 1, characterized in that the first and the second carrier, viewed in a direction parallel to a Y direction extending perpendicularly to the Z direction and the direction of movement, are positioned with respect to each other by means of at least two further tongues, which are cut and bent from the third carrier and which extend substantially without clearance through further openings in the first carrier and the second carrier, viewed in a direction parallel to the Y direction.

6. A hair removing apparatus as claimed in claim 1, characterized in that said plurality of positioning members comprises at least three positioning members.

7. A hair removing apparatus as claimed in claim 1, characterized in that said first carrier and said third carrier each have a comparatively low bending stiffness.

8. A hair removing apparatus as claimed in claim 1, characterized in that said first carrier, said second carrier and said third carrier each have a comparatively low bending stiffness.

9. A hair removing apparatus comprising two co-operating hair processing members, which can be moved with respect to each other in a direction of movement and include, respectively, a first plate-shaped carrier and a second plate-shaped carrier extending substantially parallel to the direction of movement.

said two carriers, viewed parallel to a Z direction extending substantially perpendicularly to the carriers, being positioned with respect to each other by means of at least one positioning member provided with a contact element which engages a side of the second carrier facing away from the first carrier, characterized in that the two carriers, viewed in a direction parallel to the Z direction, are positioned with respect to each other by means of a plurality of positioning members which, viewed in a direction parallel to the direction of movement, are arranged so as to be spaced apart, and at least one of the carriers has a comparatively low bending stiffness.

10. A hair removing apparatus as claimed in claim 1, characterized in that the positioning members each comprise a tongue, which is cut and bent from the first carrier and provided with the contact element near an end portion, and in that the second carrier, viewed in a direction parallel to the Z direction, is enclosed between the first carrier and the contact elements of the tongues, said tongues extending through at least one opening in the second carrier.

11. A hair removing apparatus as claimed in claim 10, characterized in that the first carrier and the second carrier, viewed in a direction parallel to a Y direction extending perpendicularly to the Z direction and the direction of movement, are positioned with respect to each other by means of at least two further tongues, which are cut and bent from the first carrier and which extend substantially without clearance through further openings in the second carrier, viewed in a direction parallel to the Y direction.

12. A hair removing apparatus as claimed in claim 10, characterized in that the first and the second carrier are ring-shaped and are each provided with substantially radially outwardly directed, cooperating cutting elements, and in that an inner edge of the first carrier is provided with a number of tongues which are bent around an inner edge of the second carrier.

13. A hair removing apparatus as claimed in claim 9, characterized in that the two co-operating hair processing members comprise, respectively, a cutting member and a hair manipulator, the cutting member being provided with a cutting edge, which extends parallel to the direction of movement, for cutting hairs growing from skin, and the hair manipulator, viewed in a displacement direction of the hair removing apparatus, being arranged in front of the cutting edge for causing a movement of the hairs and the cutting edge with respect to each other in a direction parallel to the cutting edge.

14. A hair removing apparatus as claimed in claim 13, characterized in that the cutting edge is provided on an edge of the first carrier extending parallel to the direction of movement, while the hair manipulator comprises a plurality of teeth provided at intervals with respect to each other on an edge of the second carrier extending parallel to the direction of movement.

15. A hair removing apparatus as claimed in claim 14, characterized in that one of the carriers is provided with a flanged edge extending substantially perpendicularly with respect to the carriers, and the flanged edge is provided on the second carrier.

16. A hair removing apparatus comprising two co-operating hair processing members, which can be moved with respect to each other in a direction of movement and include, respectively, first plate-shaped carrier and a second plate-shaped carrier extending substantially parallel to the direction of movement, said two carriers, viewed parallel to a Z direction extending substantially perpendicularly to the carriers, being positioned with respect to each other by means of at least one positioning member provided with a contact element which engages a side of the second carrier facing away from the first carrier, characterized in that the two carriers, viewed in a direction parallel to the Z direction, are positioned with respect to each other by means of at least three said positioning members which, viewed in a direction parallel to the direction of movement, are arranged so as to be spaced apart, and at least one of the carriers has a comparatively low bending stiffness.

17. A hair removing apparatus as claimed in claim 16, characterized in that said positioning members each comprise a respective tongue extending through a respective opening in said second carrier.

18. A hair removing apparatus as claimed in claim 17, characterized in that the two co-operating hair processing members comprise, respectively, a cutting member and a hair manipulator, the cutting member being provided with a cutting edge, which extends parallel to the direction of movement, for cutting hairs growing from skin, and the hair manipulator, viewed in a displacement direction of the hair removing apparatus, being arranged in front of the cutting edge for causing a movement of the hairs and the cutting edge with respect to each other in a direction parallel to the cutting edge.

19. A hair removing apparatus as claimed in claim 18, characterized in that the cutting edge is provided on an edge of the first carrier extending parallel to the direction of movement, while the hair manipulator comprises a plurality of teeth provided at intervals with respect to each other on an edge of the second carrier extending parallel to the direction of movement.

20. A hair removing apparatus as claimed in claim 19, characterized in that one of the carriers is provided with a flanged edge extending substantially perpendicularly with respect to the carriers, and the flanged edge is provided on the second carrier.

* * * * *